US007771175B2

(12) United States Patent
Ota et al.

(10) Patent No.: US 7,771,175 B2
(45) Date of Patent: Aug. 10, 2010

(54) VARIABLE DISPLACEMENT COMPRESSOR

(75) Inventors: Masaki Ota, Kariya (JP); Yuji Kaneshige, Kariya (JP); Motoaki Okuda, Kariya (JP); Takayuki Imai, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 1236 days.

(21) Appl. No.: 11/062,016

(22) Filed: Feb. 18, 2005

(65) Prior Publication Data

US 2005/0186086 A1 Aug. 25, 2005

(30) Foreign Application Priority Data

Feb. 24, 2004 (JP) ..... 2004-048552

(51) Int. Cl.
*F04B 27/12* (2006.01)
*F04B 1/16* (2006.01)

(52) U.S. Cl. ..... 417/269; 417/222.1; 417/521; 91/499; 91/504; 91/505; 92/12.2; 92/13

(58) Field of Classification Search ..... 417/269, 417/222.1, 222.2, 521; 91/499, 500, 501, 91/502, 503, 504, 505; 92/12.2, 13
See application file for complete search history.

(56) References Cited

U.S. PATENT DOCUMENTS 4,685,866 A * 8/1987 Takenaka et al. ..... 417/222.2
6,116,145 A * 9/2000 Ota et al. ..... 92/12.2
6,139,283 A * 10/2000 Ahn ..... 417/222.2
6,158,968 A * 12/2000 Nakamura ..... 417/222.1
6,179,571 B1 * 1/2001 Kawachi et al. ..... 417/222.1
6,186,048 B1 * 2/2001 Kimura et al. ..... 92/71
6,293,761 B1 * 9/2001 Ganster et al. ..... 417/222.1
6,402,481 B1 * 6/2002 Ahn ..... 417/222.2
2001/0031205 A1 * 10/2001 Ota et al. ..... 417/222.1
2003/0131725 A1 * 7/2003 Kurita et al. ..... 92/12.2

FOREIGN PATENT DOCUMENTS

JP 2000-170652 6/2000
JP 2001-289159 10/2001

* cited by examiner

*Primary Examiner*—Devon C. Kramer
*Assistant Examiner*—Leonard J Weinstein
(74) *Attorney, Agent, or Firm*—Knoble Yoshida & Dunleavy, LLC

(57) ABSTRACT

A link mechanism provided between a lug plate and a cam plate in a variable displacement compressor includes a first transmitting portion for transmitting rotation of a lug plate to a cam plate and a second transmitting portion for transmitting compression reactive force from the cam plate to the lug plate, which are arranged along a rotational direction of the drive shaft. The first transmitting portion includes a first transmitting surface and a first receiving surface. The link mechanism also includes a movement restrictor arranged between the first and second transmitting portions. The movement restrictor includes a restricting surface formed in the lug plate and a restricted surface formed in the cam plate and restricts the first receiving surface to move away from the first transmitting surface in the rotational direction of the drive shaft in such a manner that the restricted surface comes into contact with the restricting surface.

11 Claims, 6 Drawing Sheets

VARIABLE DISPLACEMENT COMPRESSOR

BACKGROUND OF THE INVENTION

The present invention relates to a variable displacement compressor used in a refrigerant circuit of a vehicle air-conditioner.

In a variable displacement compressor, a cylinder bore is formed in a housing and a drive shaft is rotatably supported in the housing. A lug plate is connected to the drive shaft so as to rotate therewith, and a swash plate is supported on the drive shaft so as to incline with respect to the drive shaft. A link mechanism is arranged between the lug plate and the swash plate. A piston is accommodated in the cylinder bore for reciprocation and is engaged with the outer periphery of the swash plate.

The drive shaft is rotationally driven by a vehicle engine. The rotation of the drive shaft is transmitted to the swash plate through the lug plate and the link mechanism, so that the piston is reciprocated to compress refrigerant gas. The inclination angle of the swash plate is varied while the swash plate is guided by the link mechanism so that the stroke of the piston is changed and the displacement of the compressor is varied.

Japanese Patent Application Publication No. 2001-289159 discloses a link mechanism. As shown in FIG. 8, the link mechanism includes a link pin 103 and first and second brackets 104 fixed to a swash plate 101 and a lug plate 102, respectively. The link pin 103 has at its end first and second spherical portions 103*a* and 103*b* which are formed rearward and forward with respect to a rotational direction R of the drive shaft, respectively, or the right and left sides as seen in FIG. 8. The first and second brackets 104 have their respective first and second guide grooves 102*a* and 102*b* formed at their end faces facing to the link pin 103. The first and second grooves 102*a* and 102*b* receive and guide the corresponding spherical portions 103*a* and 103*b*.

The rotation of the lug plate 102 is transmitted from the lug plate 102 to the swash plate 101 through the inner surface of the first guide groove 102*a* and the spherical surface of the first spherical portion 103*a*. Compression reactive force is eccentrically applied to the swash plate 101 through the piston, and its load center is indicated by the arrow X in FIG. 8. The compression reactive force from the second spherical portion 103*b* is mainly received by the inner surface of the second guide groove 102*b*. The swash plate 101 in varying its inclination angle is guided in such a manner that the first and second spherical portions 103*a*, 103*b* slide over the respective inner surfaces of the first and second guide grooves 102*a*, 102*b*.

Here, the rotation of the lug plate 102 is not transmitted to the swash plate 101 through the second guide groove 102*b* since the second guide groove 102*b* is located on the preceding side of the rotational direction R with respect to the second spherical portion 103*b*. And also, the inner surface area of the second guide groove 102*b* that faces to the swash plate 101 receives the compression reactive force but other surface area does not. Accordingly, a wall portion 104*a* of the second bracket 104 is relevant to neither transmitting the lug plate rotation to the swash plate 101 nor transmitting the compression reactive force X from the swash plate 101 to the lug plate 102. The wall portion 104*a* of the second bracket 104 functions to restrict the swash plate 101 from further rotating toward the preceding side of the rotational direction R relative to the lug plate 102 when the second spherical portion 103*b* comes into contact with the inner surface of the second guide groove 102*b*. If the wall portion 104*a* of the second bracket 104 is simply removed, the swash plate 101 would substantially wobble forward and backward of the rotational direction R relative to the lug plate 102. Namely, when the swash plate 101 substantially wobbles forward and backward of the rotational direction R, the first spherical portion 103*a* repeatedly and fiercely collides with the inner surface of the first guide groove 102*a*, so that the variable displacement compressor generates abnormal noise and vibration.

Meanwhile, when the wall portion 104 of the second bracket 104 is provided, since the wall portion 104*a* has to have certain thickness, the interval between the first and second spherical portions 103*a*, 103*b* and the interval between the first and second guide grooves 102*a*, 102*b* has to be narrow by the thickness of the wall portion 104*a*. When the interval between the first and second spherical portions 103*a*, 103*b* and the interval between the first and second guide grooves 102*a*, 102*b* are narrow, the support of the swash plate 101 by the lug plate 102 is unstable under the compression reactive force X which is eccentrically applied to the radially outer portion of the swash plate 101. The eccentrically applied compression reactive force X makes the swash plate 101 incline in a direction different from its inclining direction when the displacement is varied. Due to this differently inclining swash plate 101, the first and second spherical portions 103*a*, 103*b* contact the respective first and second guide grooves 102*a*, 102*b* in different manners, so that sliding resistance between them becomes large. Thus, controllability of the displacement of the variable displacement compressor deteriorates.

The present invention is directed to a variable displacement compressor having a link mechanism that prevents a cam plate from substantially wobbling forward and backward along the rotational direction and being inclined in a direction different from its inclining direction when the displacement is varied.

SUMMARY OF THE INVENTION

According to the present invention, a variable displacement compressor for compressing gas includes a housing having a cylinder bore. A drive shaft is rotatably supported by the housing. A lug plate is connected to the drive shaft so as to rotate together with the drive shaft. A cam plate is supported on the drive shaft so as to incline with respect to the drive shaft. A piston is accommodated in the cylinder bore for reciprocation and engaged with the cam plate. A link mechanism is provided between the lug plate and the cam plate for transmitting rotation of the lug plate to the cam plate to reciprocate the piston thereby performing gas compression. An inclination angle of the cam plate being varied while being guided by the link mechanism to change a stroke volume of the piston so that displacement of the compressor is varied. The link mechanism includes a support portion protruding from the cam plate toward the lug plate, a first transmitting portion for transmitting rotation of the lug plate to the cam plate, the first transmitting portion includes a first transmitting surface formed in the lug plate and a first receiving surface formed in the cam plate, a second transmitting portion for transmitting compression reactive force from the cam plate to the lug plate, the second transmitting portion includes a second transmitting surface formed on a peripheral surface of a roller rotatably supported by the support portion and a second receiving surface formed in the lug plate, the first and second transmitting portions being arranged along a rotational direction of the drive shaft, the support portion being arranged between the first and second transmitting portions in the rotational direction of the drive shaft, and a movement restrictor arranged between the first transmitting portion and the second transmitting portion, the movement restrictor includes a restricting surface formed in the lug plate and a restricted surface protruding from the support portion, wherein a movement of the first receiving surface away from the first transmitting surface in the rotational direction of the drive shaft is restricted by the movement restrictor in such a manner that the restricted surface comes into contact with the restricting surface.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe the preferred embodiment, in which the present invention is applied to a variable displacement compressor used in a refrigerant circuit of a vehicle air-conditioner.

Figure 1:
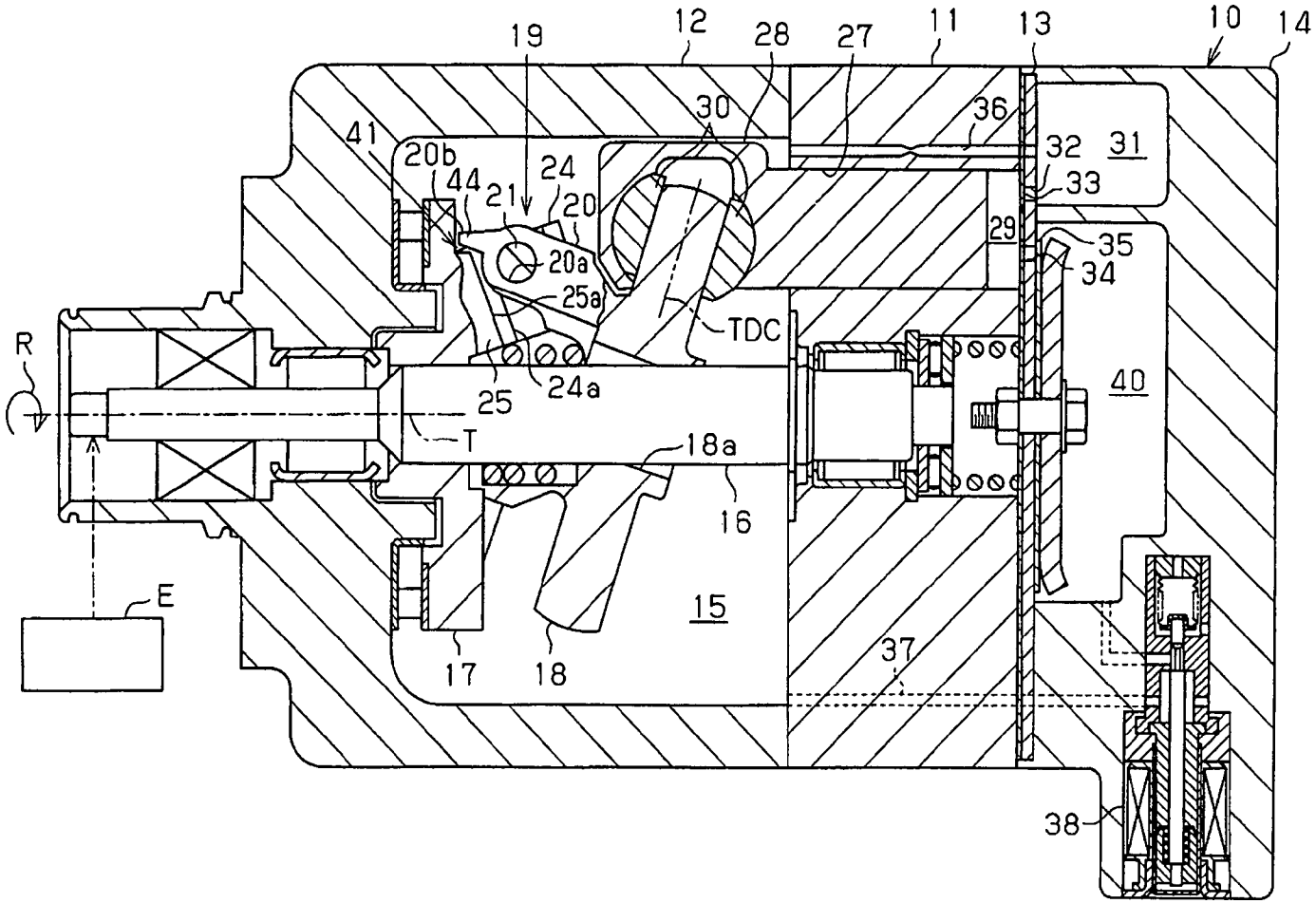
FIG. 1 is a longitudinal cross-sectional view of a variable displacement compressor having the preferred embodiment of the link mechanism according to the present invention.

FIG. 1 shows a variable displacement compressor 10. In FIG. 1, the left side and the right side respectively correspond to the front side and the rear side of the compressor 10. As shown in FIG. 1, the housing of the compressor 10 includes a cylinder block 11, a front housing 12 and a rear housing 14. The front housing 12 is fixed to the front end of the cylinder block 11, and the rear housing 14 is fixed to the rear end of the cylinder block 11 through a valve plate assembly 13.

In the housing, a crank chamber 15 is defined by the cylinder block 11 and the front housing 12. A drive shaft 16 is rotatably supported by the cylinder block 11 and the front housing 12 and extends in the crank chamber 15. An engine E or a drive source for a vehicle is operatively connected to the drive shaft 16. The drive shaft 16 receives the driving power from the engine E and is rotated on its axis T in the direction indicated by an arrow R in FIG. 1.

A substantially disc-shaped lug plate 17 is mounted on the drive shaft 16 in the crank chamber 15 so as to rotate therewith. A swash plate 18 or a cam plate is accommodated in the crank chamber 15 and has a through hole 18*a* at its center portion. The drive shaft 16 is inserted through the through hole 18*a*. A link mechanism 19 is arranged between the lug plate 17 and the swash plate 18 and connects the lug plate 17 and the swash plate 18. The connection is between the lug plate 17 and the swash plate 18 through the link mechanism 19 and allows the swash plate 18 to rotate synchronously with the lug plate 17 and the drive shaft 16. The support by the drive shaft 16 through the through hole 18*a* also allows the swash plate 18 to incline with respect to the drive shaft 16 while it slides along the axis T of the drive shaft 16.

A plurality of cylinder bores 27 is formed in the cylinder block 11 to extend therethrough in the longitudinal direction of the compressor 10 and equiangularly arranged around the axis T of the drive shaft 16. Only one cylinder bore 27 is shown in FIG. 1. A single-headed piston 28 is accommodated in each of the cylinder bores 27 so as to move in the longitudinal direction. The openings of the cylinder bore 27 is respectively closed by the front end surface of the valve plate assembly 13 and the piston 28, thereby defining a compression chamber 29 in the cylinder bore 27. The compression chamber 29 is varied in volume in accordance with the movement of the piston 28 in the longitudinal direction.

The piston 28 is engaged with a pair of shoes 30 at an outer periphery of the swash plate 18. The rotational movement of the swash plate 18 is converted into the reciprocating movement of the piston 28 through the shoes 30. In the rear housing 14, a suction chamber 31 and a discharge chamber 40 are defined. A suction port 32 and a suction valve 33 provided in the valve plate assembly 13 are located between the compression chamber 29 and the suction chamber 31. A discharge port 34 and a discharge valve 35 provided in the valve plate assembly 13 are located between the compression chamber 29 and the discharge chamber 40.

As the piston 28 moves from its top dead center to its bottom dead center, refrigerant gas (carbon dioxide) in the suction chamber 31 is drawn to the compression chamber 29 through the suction port 32 and the suction valve 33. As the piston 28 moves from its bottom dead center to its top dead center, the drawn refrigerant gas in the compression chamber 29 is compressed to a predetermined pressure and discharged to the discharge chamber 40 through the discharge port 34 and the discharge valve 35.

In the housing of the compressor 10, a bleed passage 36, a supply passage 37 and a control valve 38 are arranged. The bleed passage 36 interconnects the crank chamber 15 with the suction chamber 31. The supply passage 37 interconnects the discharge chamber 40 with the crank chamber 15. The control valve 38 which is an electromagnetic control valve is arranged on the supply passage 37.

By adjusting an opening degree of the control valve 38, the pressure balance is controlled between the high-pressure discharge gas introduced from the discharge chamber 40 into the crank chamber 15 through the supply passage 37 and the gas flowing from the crank chamber 15 into the suction chamber 31 through the bleed passage 36. Thus, the internal pressure in the crank chamber 15 is determined. In accordance with the variation of the internal pressure in the crank chamber 15, the pressure difference is changed between the crank chamber 15 and the compression chamber 29 by the piston 28, and the inclination angle of the swash plate 18 is varied. Consequently, the stroke of the piston 28, that is, the displacement of the compressor 10 is adjusted. The inclination angle of the swash plate 18 is defined as an angle made between the swash plate 18 and a hypothetical plane perpendicular to the axis T of the drive shaft 16.

As the internal pressure in the crank chamber 15 is decreased, the inclination angle of the swash plate 18 is increased, and the stroke of the piston 28 is increased. Consequently, the displacement of the compressor 10 is increased. On the other hand, as the internal pressure in the crank chamber 15 is increased, the inclination angle of the swash plate 18 is decreased, and the stroke of the piston 28 is decreased. Consequently, the displacement of the compressor 10 is decreased. In the state as shown in FIG. 1, the lug plate 17 restricts the increase of the inclination angle of the swash plate 18 by contact, and the swash plate is inclined at the maximum inclination angle.

Figure 2:
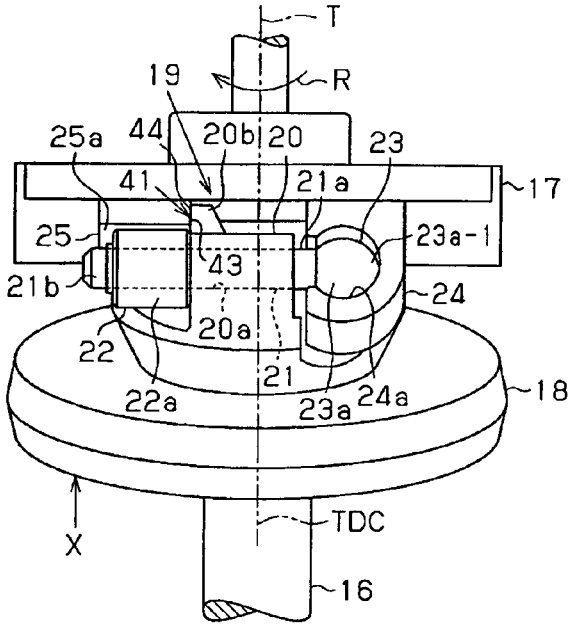
FIG. 2 is a top view of the link mechanism as shown in FIG. 1.
Figure 3:
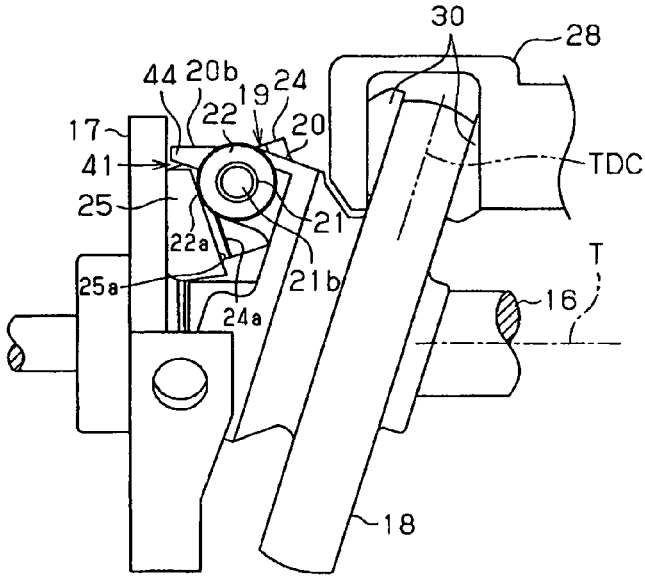
FIG. 3 is a side view of the link mechanism as shown in FIG. 2.

The following will describe the link mechanism 19. Firstly, elements provided on the swash plate 18 that constitutes the link mechanism 19 will be described. As shown in FIGS. 1 through 3, a support portion 20 protrudes from the end face of the swash plate 18 toward the lug plate 17 in the vicinity of a position corresponding to the top dead center of the swash plate 18 herein after referred to as the position TDC. The position TDC places the piston 28 at its top dead center. A through hole 20*a* is formed through the support portion 20 and extends in a direction perpendicular to the protruding direction of the support portion 20. A link pin 21 is fixedly fitted into the through hole 20*a* of the support portion 20. In the link pin 21, a first end 21*a* (an end on the right side in FIG. 2) protrudes from the support portion 20 toward the following side of the rotational direction R or the right side as seen in FIG. 2, and a second end 21*b* (an end on the left side in FIG. 2) protrudes from the support portion 20 toward the preceding side of the rotational direction R or the left side as seen in FIG. 2.

A cylindrical roller 22 is supported by the second end 21*b* of the link pin 21 so as to rotate thereon. In order to improve its abrasion resistance, soft nitriding treatment is performed on an outer peripheral surface 22*a* of the roller 22 when the roller 22 is made of steel. Or, the roller 22 is made of high-silicon aluminum material. The link pin 21 is formed with a spherical portion 23 at its first end 21*a*. The roller 22 and the spherical portion 23 are arranged so as to place the direction TDC of the swash plate 18 therebetween along the rotational direction R.

Now, elements provided on the lug plate 17 that constitutes the link mechanism 19 will be described. A first cam portion 24 protrudes from the end face of the lug plate 17 toward the swash plate 18 and has a groove for guiding the spherical portion 23. The groove has a cylindrical inner surface 24*a* which is partially removed for receiving the spherical portion 23 of the link pin 21. As shown in FIG. 3, the inner surface 24*a* is inclined so as to increase the distance from the lug plate 17 as the inner surface 24*a* comes close to the drive shaft 16.

As shown in FIG. 2, a second cam portion 25 protrudes from the end face of the lug plate 17 toward the swash plate 18 and is located on the preceding side of the rotational direction R with respect to the first cam portion 24. The second cam portion 25 has a cam surface 25*a* for guiding the roller 22. The cam surface 25*a* is inclined toward the lug plate 17 so as to increase the distance from the lug plate 17 as the cam surface 25*a* comes close to the drive shaft 16. The second cam portion 25 does not have any side wall that faces the roller 22 except for the cam surface 25*a*. That is, the second cam portion 25 is formed in a shape so that the roller 22 is open to the preceding side of the rotational direction R and the side of the swash plate 18.

The rotation of the lug plate 17 is transmitted to the swash plate 18 through the inner surface 24*a* of the first cam portion 24 and a spherical surface 23*a* of the spherical portion 23 (specifically its end region 23*a*-1). Compression reactive force is eccentrically applied to the radially outer portion of the swash plate 18 through the piston 28, and its load center is indicated by the arrow X in FIG. 2. The compression reactive force is mainly received by the cam surface 25*a* of the second cam portion 25 through the outer peripheral surface 22*a* of the roller 22.

Namely, in the preferred embodiment, the link mechanism includes the rotation transmitting portion and the compression reactive force transmitting portion. The former includes the groove inner surface 24*a* of the first cam portion 24 provided in the lug plate 17 and the spherical portion 23 of the link pin 21 provided in the swash plate 18. The latter includes the roller 22 of the link pin 21 and the cam surface 25*a* of the second cam portion 25.

As the displacement of the compressor 10 increases, the swash plate 18 is guided so that the spherical portion 23 slides over the inner surface 24*a* of the first cam portion 24 in a direction to move away from the drive shaft 16, and so that the roller 22 rolls on the cam surface 25 of the second cam portion 25 in the direction to move away from the drive shaft 16. On the other hand as the displacement of the compressor 10 decreases, the swash plate 18 is guided so that the spherical portion 23 slides over the inner surface 24*a* of the first cam portion 24 in a direction to come closer to the drive shaft 16 and so that the roller 22 rolls on the cam surface 25 of the second cam portion 25 in the direction to come closer to the drive shaft 16. Usage of the roller 22 as an element of the link mechanism 19 enables smooth variation in the inclination angle of the swash plate 18.

Figure 4:
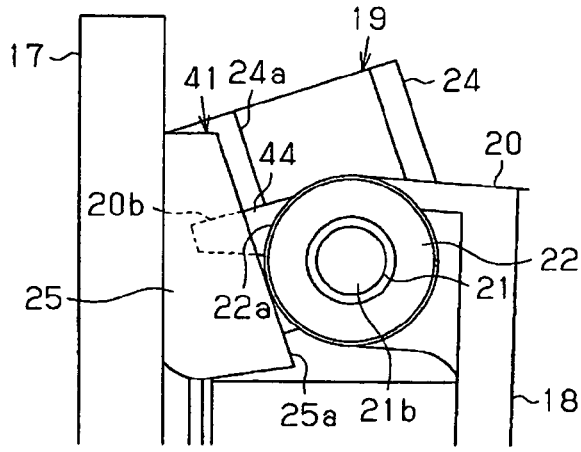
FIG. 4 is a partially enlarged view of the link mechanism as shown in FIG. 3 in a state where a swash plate is inclined but not at its maximum inclination angle.

As shown in FIGS. 2 and 4, a movement restrictor 41 is arranged between the rotation transmitting portion (the inner surface 24*a* of the first cam portion 24 and the spherical surface 23*a* of the spherical portion 23) and the compression reactive force transmitting portion (the outer peripheral surface 22*a* of the roller 22 and the cam surface 25*a* of the second cam portion 25) in the link mechanism 19. The movement restrictor 41 includes the second cam portion 25 provided in the lug plate 17 and the support portion 20 provided in the swash plate 18.

Namely, the second cam portion 25 has a restricting surface 43 formed as a planar surface that faces toward the following side of the rotational direction of the shaft 16. The support portion 20 has a protrusion 20*b* which protrudes toward the lug plate 17 from the top end of the support portion 20 near the roller 22. The protrusion 20*b* has a restricted surface 44 as a planar surface that faces toward the preceding side of the rotational direction R. The restricted surface 44 comes in contact with the restricting surface 43. Thus, even when the torque of the engine E fluctuates, the swash plate 18 is prevented from substantially rotating or wobbling relative to the lug plate 17 frontward and backward of the rotational direction R. Consequently, the compressor 10 substantially prevents abnormal noise and vibration.

The restricting surface 43 of the lug plate 17 extends in a direction that the protrusion 20*b* moves in accordance with the inclination of the swash plate 18. Here, the extending range of the restricting surface 43 does not cover the entire moving range of the restricted surface 44. Namely, when the inclination angle of the swash plate 18 is substantially the maximum as shown in FIGS. 1 and 3, the restricting surface 43 and the restricted surface 44 do not face with each other.

The movement restrictor 41 is so constructed to change between two states in accordance with the variation in the inclination angle of the swash plate 18. Namely, in a restricting state, the restricted surface 44 comes in contact with the restricting surface 43 by slight wobble of the swash plate 18 relative to the lug plate 17 as shown in FIG. 4 and in a non-restricting state, the restricted surface 44 is out of contact with the restricting surface 43 even when the swash plate 18 wobbles relative to the lug plate 17 shown in FIG. 3. When the inclination angle of the swash plate 18 is substantially the maximum, the movement restrictor 41 is in the non-restricting state in the present preferred embodiment. When the inclination angle of the swash plate 18 is not the maximum (when the inclination angle of the swash plate 18 is the minimum also), the movement restrictor 41 is in the restricting state.

It is noted that the swash plate 18 tends to substantially wobble back and forth in the rotational direction R relative to the lug plate 17 when the displacement of the compressor 10 is not substantially the maximum, particularly when the displacement of the compressor 10 is substantially the minimum. It is because the compression reactive force X applied to the swash plate 18 is small when the displacement of the compressor 10 is small, and the swash plate 18 is softly pressed against the lug plate 17 by the small compression reactive force X. Therefore, even though the movement restrictor 41 is in the non-restricting state when the displacement of the compressor 10 is substantially the maximum, it is not disadvantageous for preventing the swash plate 18 from substantially wobbling relative to the lug plate 17.

According to the above-constructed preferred embodiment, the following advantageous effects are obtained.

(1) The movement restrictor 41 is arranged between the rotation transmitting portion (the inner surface 24*a* of the first cam portion 24 and the spherical surface 23*a* of the spherical portion 23) and the compression reactive force transmitting portion (the outer peripheral surface 22*a* of the roller 22 and the cam surface 25*a* of the second cam portion 25) for preventing the swash plate 18 from substantially wobbling. Thus, the interval between the power transmitting portion and the compression reactive force transmitting portion is easily made wider without being affected by the arrangement of the movement restrictor 41. Therefore, the swash plate 18 is supported by the lug plate 17 stably with respect to the compression reactive force X eccentrically applied to the radially outer portion of the swash plate 18. Consequently, the stable support of the swash plate 18 prevents the swash plate 18 from inclining in a direction different from its inclining direction when the displacement is varied, even when the compression reactive force X is eccentrically applied to the swash plate 18.

Figure 9:
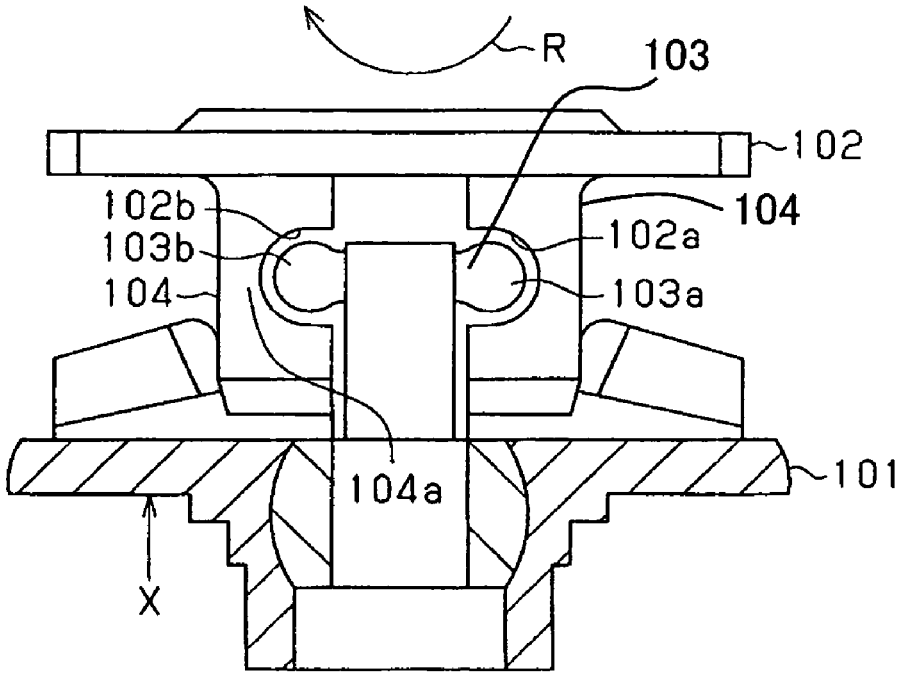
FIG. 9 (PRIOR ART)

The movement restrictor 41 is provided for preventing the swash plate 18 from substantially wobbling. Thus, the restricting surface 43 and the restricted surface 44 can be freely designed in setting shape, size and location in comparison with the technique disclosed in Unexamined Japanese Patent Application Publication No. 2001-289159, in which a part of the compression reactive force transmitting portion (the second bracket 104 in FIG. 9, more specifically the wall portion 104*a*) is used for preventing the swash plate 18 from substantially wobbling. Thus, the movement restrictor 41 is more effective for preventing the swash plate 18 from substantially wobbling.

(2) The movement restrictor 41 is so constructed to change between the restricting state where the restricted surface 44 comes into contact with the restricting surface 43 by the slight wobble of the swash plate 18; and the non-restricting state where the restricted surface 44 is out of contact with the restricting surface 43 even when the swash plate 18 wobbles, in accordance with the variation of the inclination angle of the swash plate 18. Thus, in assembling the compressor 10, the elements of the link mechanism 19 in the swash plate 18 (specifically the spherical portion 23) and the elements of the link mechanism 19 in the lug plate 17 (specifically the first cam portion 24) are easily coupled to each other in a state where the movement restrictor 41 is in the non-restricting state. Namely, the above structure of the movement restrictor 41 facilitates the assembling work.

In a case where the movement restrictor 41 is constructed so as not to be in the non-restricting state at any inclination angle of the swash plate 18 (this case does not depart from the scope of the present invention), the spherical portion 23 needs to be inserted into the first cam portion 24 while the restricting surface 43 faces to the restricted surface 44 in the rotational direction R in assembling the compressor 10. Thus, the work for connecting the swash plate 18 to the lug plate 17 is a limited and troublesome procedure. In the present preferred embodiment, the spherical portion 23 is inserted into the first cam portion 24 in a state where the swash plate 18 is inclined substantially at the maximum inclination angle. Then, the inclination angle of the swash plate 18 is changed from its maximum so that the restricting surface 43 faces to the restricted surface 44 in the rotational direction R. Therefore, the work for connecting the swash plate 18 to the lug plate 17 becomes easy.

(3) The movement restrictor 41 is so constructed to be in the restricting state at the minimum inclination angle of the swash plate 18, at which the swash plate 18 is most likely to wobble. Thus, the swash plate 18 is more effectively prevented from substantially wobbling.

(4) The movement restrictor 41 is constructed so as to be in the non-restricting state at the approximately maximum inclination angle of the swash plate 18, at which the swash plate 18 is least likely to wobble. Thus, the movement restrictor 41 both prevents the swash plate 18 from substantially wobbling and facilitates the work for connecting its elements on the swash plate 18 to its elements on the lug plate 17.

(5) The restricting surface 43 and the restricted surface 44 are planes. It is easy to process planes and control their dimensions. Thus, the swash plate 18 is more effectively prevented from substantially wobbling.

(6) The protrusion 20*b* protrudes from the support portion 20 that supports the roller 22, and the restricted surface 44 is formed in the protrusion 20*b*. Thus, the movement restrictor 41 is made smaller in size in comparison with a case where an additional protrusion directly protrudes from the swash plate 18 toward the lug plate 17 for forming the restricted surface 44.

The restricting surface 43 is formed in the second cam portion 25 that forms the cam surface 25*a*. Thus, the movement restrictor 41 is made simple in structure in comparison with a case where an additional protrusion directly protrudes from the lug plate 17 toward the swash plate 18 for forming the restricting surface 43.

The following alternative embodiments are practicable according to the present invention.

Figure 5:
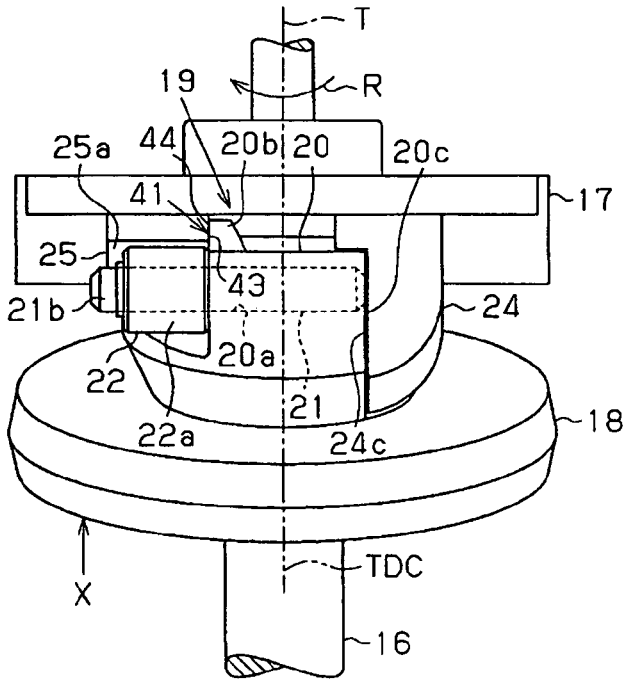
FIG. 5 is a top view of an alternative embodiment of the link mechanism according to the present invention.

As shown in FIG. 5, the spherical portion 23 is removed from the link pin 21 and the groove shape (the inner surface 24*a*) is removed from the first cam portion 24 in the link mechanism 19. The first cam portion 24 has a side surface 24*c* of the support portion 20 that faces toward the following side of the rotational direction R, and the support portion 20 has a side surface 20*c* of the first cam portion 24 that faces toward the preceding side of the rotational direction R. The side surface 24*c* comes into contact with the side surface 20*c* to transmit the rotation of the lug plate 17 to the swash plate 18. Thus, the link mechanism 19 is made simple in structure, and the cost of the compressor 10 is reduced.

Figure 6:
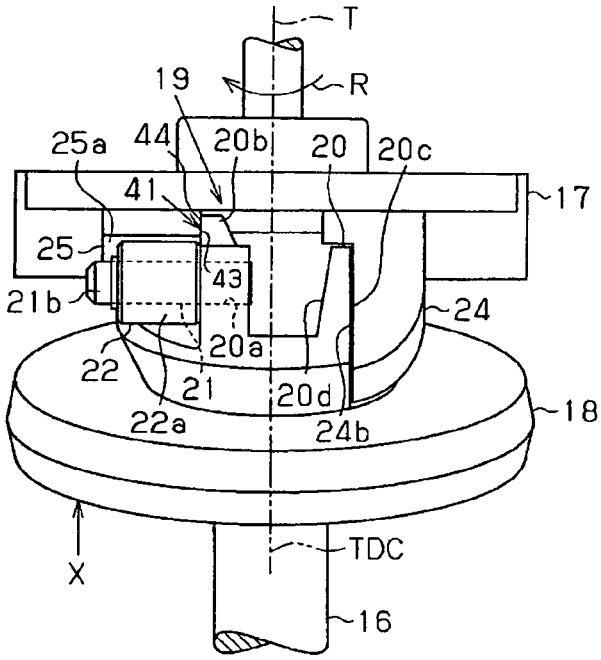
FIG. 6 is a top view of an alternative embodiment of the link mechanism according to the present invention.

As shown in FIG. 6, the embodiment shown in FIG. 5 is changed, and a recess 20*d* is formed in the support portion 20 for weight saving. Thus, the weight of the swash plate 18 or the compressor 10 is reduced.

Figure 7:
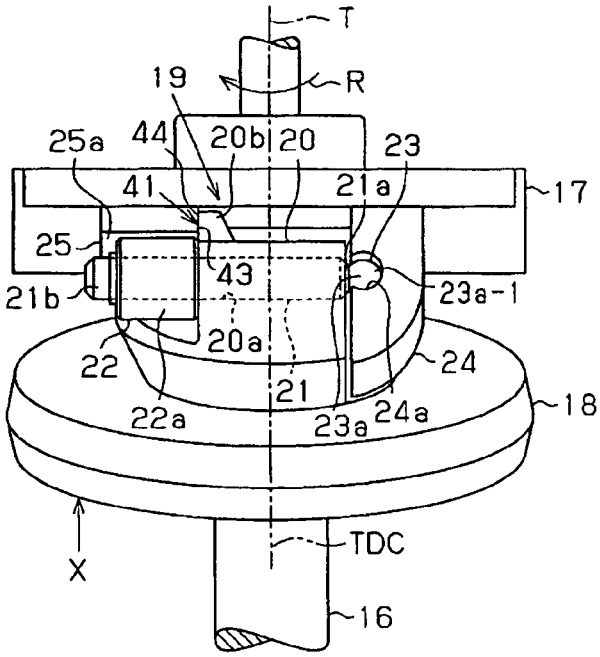
FIG. 7 is a top view of an alternative embodiment of the link mechanism according to the present invention.
Figure 8:
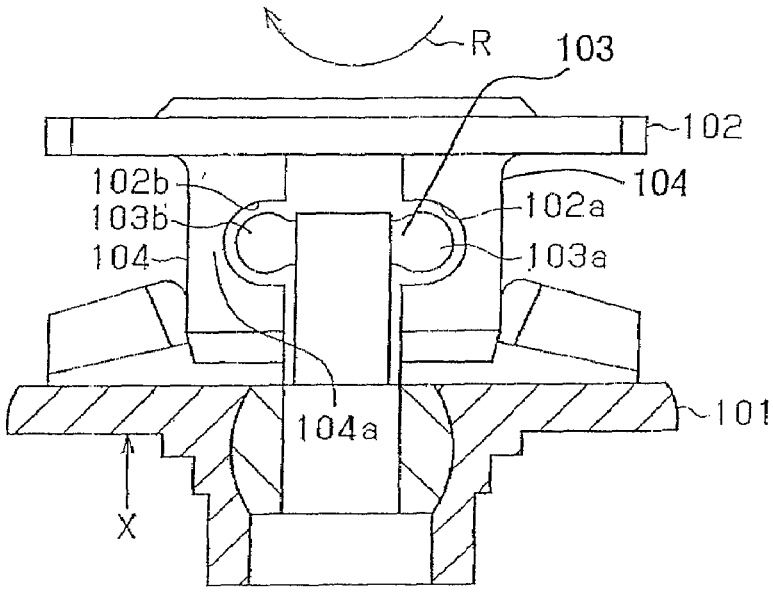
FIG. 8 (PRIOR ART)
FIG. 8 is a top view of the link mechanism according to prior art.

As shown in FIG. 7, the outer diameter of the spherical portion 23 is smaller than that of the link pin 21 (the inner diameter of the through hole 20*a*) in the link mechanism 19. Thus, an assembly process is adopted, in which the link pin 21 is installed through the through hole 20*a* by inserting the spherical portion 23 through the through hole 20*a* after the link pin 21 is formed with the spherical portion 23. Therefore, the link pin 21 with the spherical portion 23 is prepared and the roller 22 is installed on the link pin 21 in advance, which makes it easy to assemble the compressor 10.

The present invention is applied to the compressor having the similar link mechanism as disclosed in Japanese Patent Application Publication No. 2001-289159. Namely, the link mechanism 19 is constituted of a pair of spherical portions formed in one of the lug plate 17 and the swash plate 18 and a pair of guide grooves formed in the other of the lug plate 17 and the swash plate 18.

The present invention is applicable to a wobble type variable displacement compressor.

The present examples and embodiments are to be considered as illustrative and not restrictive, and the invention is not to be limited to the details given herein but may be modified within the scope of the appended claims.

What is claimed is:

1. A variable displacement compressor for compressing gas comprising:

a housing having a cylinder bore;

a drive shaft rotatably supported by the housing;

a lug plate connected to the drive shaft so as to rotate together with the drive shaft;

a cam plate supported on the drive shaft so as to incline with respect to the drive shaft;

a piston accommodated in the cylinder bore for reciprocation, the piston being engaged with the cam plate; and a link mechanism provided between the lug plate and the cam plate for transmitting rotation of the lug plate to the cam plate to reciprocate the piston thereby performing gas compression, an inclination angle of the cam plate being varied while being guided by the link mechanism to change stroke of the piston so that displacement of the compressor is varied, the link mechanism including:

support portion protruding from the cam plate toward the lug plate;

a first transmitting portion for transmitting rotation of the lug plate to the cam plate, the first transmitting portion including a first transmitting surface formed in the lug plate and a first receiving surface formed in the cam plate;

a second transmitting portion for transmitting compression reactive force from the cam plate to the lug plate, the second transmitting portion including a second transmitting surface formed on a peripheral surface of a roller rotatably supported by the support portion and a second receiving surface formed in the lug plate, the first and second transmitting portions being arranged along a rotational direction of the drive shaft, the support portion being arranged between the first and second transmitting portions in the rotational direction of the drive shaft; and a movement restrictor arranged between the first transmitting portion and the second transmitting portion, the movement restrictor including a restricting surface formed in the lug plate and a restricted surface protruding from the support portion, wherein a movement of the first receiving surface away from the first transmitting surface in the rotational direction of the drive shaft is restricted by the movement restrictor in such a manner that the restricted surface comes into contact with the restricting surface.

2. The variable displacement compressor according to claim 1, wherein the movement restrictor is changed between a restricting state where the restricted surface comes into contact with the restricting surface and a non-restricting state where the restricted surface is out of contact with the restricting surface in accordance with variation of the inclination angle of the cam plate.

3. The variable displacement compressor according to claim 2, wherein the movement restrictor is in the restricting state at least when the inclination angle of the cam plate is the minimum.

4. The variable displacement compressor according to claim 2, wherein the movement restrictor is in the non-restricting state when the inclination angle of the cam plate is substantially the maximum.

5. The variable displacement compressor according to claim 1, wherein the restricting surface and the restricted surface are planar.

6. The variable displacement compressor according to claim 1, wherein the link mechanism includes a first cam portion protruding from the lug plate toward the cam plate for forming the first transmitting surface, and wherein the support portion has a hole and a pin fixedly fitted in the hole, the pin including at its end a spherical portion that forms the first receiving surface.

7. The variable displacement compressor according to claim 6, wherein an outer diameter of the spherical portion is smaller than an inner diameter of the hole of the support portion.

8. The variable displacement compressor according to claim 1, wherein the link mechanism includes a first cam portion protruding from the lug plate toward the cam plate, the first cam portion having a side surface that is the first transmitting surface, the support portion having a side surface that is the first receiving surface.

9. The variable displacement compressor according to claim 8, wherein a recess is formed in the support portion.

10. The variable displacement compressor according to claim 1, wherein the link mechanism includes a second cam portion protruding from the lug plate toward the cam plate for forming the restricting surface and the second receiving surface.

11. The variable displacement compressor according to claim 1, wherein the link mechanism includes a second cam portion protruding from the lug plate toward the cam plate for forming the restricting surface and the second receiving surface, wherein the second cam portion is formed in a shape so that the roller is opened to a preceding side of the rotational direction of the drive shaft and the side of the swash plate.

* * * * *